United States Patent [19]

Shaw

[11] 4,329,928

[45] May 18, 1982

[54] RECIPROCABLE STORAGE RACKS

[76] Inventor: Alvin W. Shaw, 803 Maryland Ave., Pittsburgh, Pa. 15232

[21] Appl. No.: 173,103

[22] Filed: Jul. 28, 1980

[51] Int. Cl.[3] ..... A47B 9/06; A47F 3/08

[52] U.S. Cl. ..... 108/106; 187/95; 211/1.5; 312/312

[58] Field of Search ..... 198/798; 187/3, 8.59, 187/8.69, 19, 95; 108/106; 211/151, 121, 1.5; 312/306, 312; 74/89.17, 89.11, 89.12, 76, 79, 133

[56] References Cited

U.S. PATENT DOCUMENTS

| | | | |
|---|---|---|---|
| 139,907 | 6/1873 | McCall et al. | 312/312 X |
| 330,201 | 11/1885 | Baynes et al. | 312/312 |
| 682,517 | 9/1901 | Bahnemann | 211/121 |
| 1,583,887 | 5/1926 | Kilbourn | 312/306 X |
| 2,703,643 | 3/1955 | Parsons | 211/121 X |
| 2,829,780 | 4/1958 | Boor | 211/121 |
| 2,861,857 | 11/1958 | Lee et al. | 312/312 X |
| 2,875,012 | 2/1959 | Riley | 312/312 X |
| 3,187,880 | 6/1965 | Frater et al. | 211/121 X |
| 3,231,103 | 9/1966 | Tantlinger | 211/49 |
| 3,313,376 | 4/1967 | Holland, Sr. | 187/95 X |
| 3,327,868 | 6/1967 | Muller | 211/1.5 |
| 3,356,183 | 12/1967 | Shell | 187/3 |
| 3,426,912 | 2/1969 | Perini | 211/121 |
| 3,784,020 | 1/1974 | Steiner | 211/1.3 |
| 3,851,764 | 12/1974 | Anders | 211/121 X |
| 4,065,194 | 12/1977 | Mattia | 108/147 X |

FOREIGN PATENT DOCUMENTS

| | | | |
|---|---|---|---|
| 838175 | 2/1939 | France | 312/312 |
| 379901 | 4/1940 | Italy | 312/312 |
| 375119 | 3/1964 | Switzerland | 312/312 |
| 800106 | 8/1958 | United Kingdom | 108/106 |

*Primary Examiner*—James T. McCall

*Attorney, Agent, or Firm*—Buell, Blenko, Ziesenheim & Beck

[57] ABSTRACT

A reciprocable storage rack is provided having vertically movable rack frames with shelves on opposite sides of a main frame whose length is substantially twice that of the rack frames and is mounted in a well below a working surface, the well depth being substantially equal to the length of the storage racks and drive means arranged to raise and lower the racks to provide a counterbalance effect.

4 Claims, 5 Drawing Figures

RECIPROCABLE STORAGE RACKS

This invention relates to reciprocable storage racks and particularly to a structure having vertically reciprocable shelves or the like which may be moved to position a particular shelf at a desired working level.

There have been provided a variety of apparatus having movable shelves or racks designed to make the shelves more accessible to a user. Generally such devices as have heretofore been proposed are based upon a chain conveyor arrangement in which the shelves are pivotally mounted on a conveyor chain which rotates around top and bottom pulleys with the shelves arranged in a self-levelling arrangement. Such arrangements require relatively complex self-levelling shelf arrangements as well as a relatively complex chain conveyor system. In addition, they require careful loading in order to prevent tipping and the like problems. Typical of such prior art devices are those shown in U.S. Pat. Nos. 682,517, 2,703,643, 2,829,780, 3,187,880, 3,426,912 and 3,851,764. Another and different movable showcase arrangement is illustrated in Kilbourn U.S. Pat. No. 1,583,887. In this arrangement a showcase is mounted on a piston in a cylinder below floor level so that one-half of the showcase can go beneath the floor surface. A screen depending from the ceiling covers the other half of the showcase when raised and also covers the counterbalance cables which pass over a sheave on the ceiling and connect the top of the showcase to a counterbalance weight which slides behind it. This is a very complex structure and yet permits only a very limited movement of the showcase.

I have invented a reciprocable storage rack which is simple in structure and totally accessible. My structure eliminates the need for counterbalance weights, conveyor chains and special suspensions.

I provide a vertically reciprocable storage rack assembly comprising a vertical main frame, a pair of spaced substantially parallel tracks mounted adjacent each side edge of said frame, a vertical storage rack frame having a length substantially half the length of the main frame, spaced shelves on said storage rack frame, at least two pairs of guide wheels on said storage rack frame at least one pair adjacent the top and one pair adjacent the bottom, said guide wheels being mounted for movement between said pairs of tracks, drive means on the main frame drivingly engaging said storage rack frame for movement vertically on said tracks and a well means beneath the level of a working surface for said shelves, equal in depth to substantially the length of the storage frame, said main frame being mounted in said well whereby the top of the storage frame is substantially level with said working surface in its lowermost position and the bottom of the storage frame is substantially level with the work surface at its uppermost position. Preferably, I provide two storage rack frames, one on each side of the main frame, each having at least pairs of top and bottom guide wheels running between pairs of substantially parallel rails on the side edges of the frame. The drive means is preferably an electric motor driving gears on opposite sides of the main frame in continuous driving engagement with toothed rack means on the storage rack frame. The drive is preferably arranged so that as one storage rack frame is raised, the other is lowered, providing an automatic counterbalancing effect. In an alternate form the storage rack is mounted on side rails, one on each side running between spaced opposed guide wheels on the main frame.

In the foregoing general description of this invention, I have set out certain purposes, objects and advantages of my invention. Other objects, purposes and advantages of this invention will be apparent from a consideration of the following description and the accompanying drawings in which.

Figure 1:
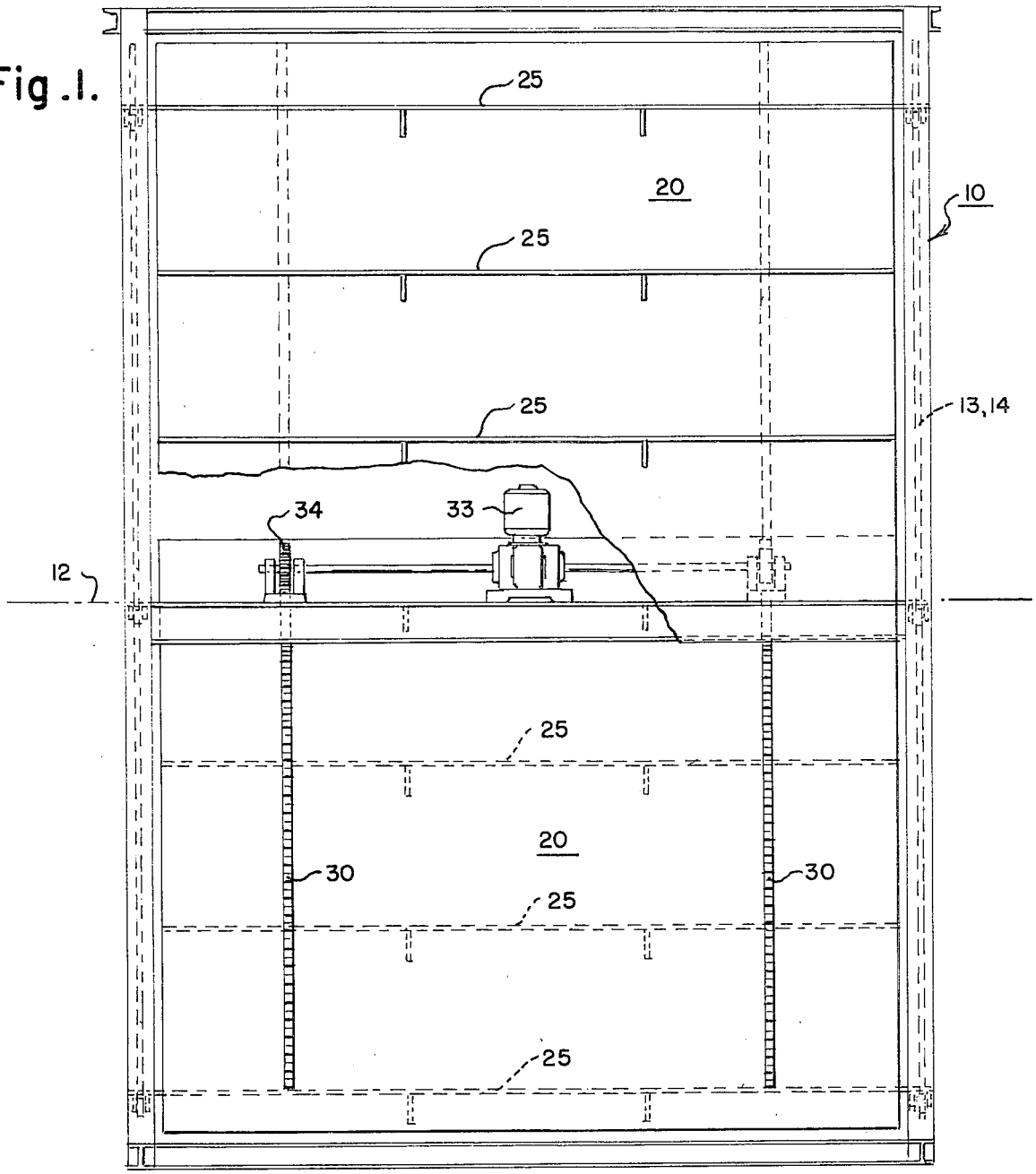
FIG. 1 is a front elevational view of a vertically reciprocable storage rack according to this invention, partly cut away.
Figure 4:
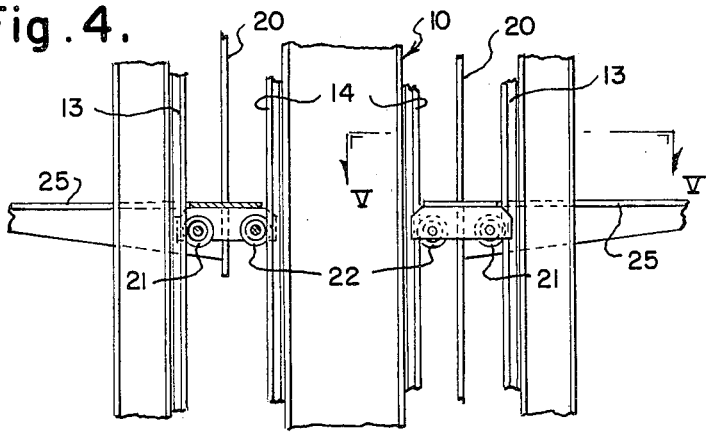
FIG. 4 is an enlarged fragmentary view of a section of the main frame and rack frames showing the guide arrangement.
Figure 5:
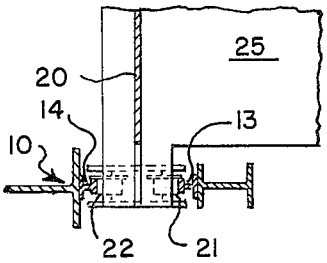
FIG. 5 is a fragmentary sectional view on the line V—V of FIG. 4.
Figure 2:
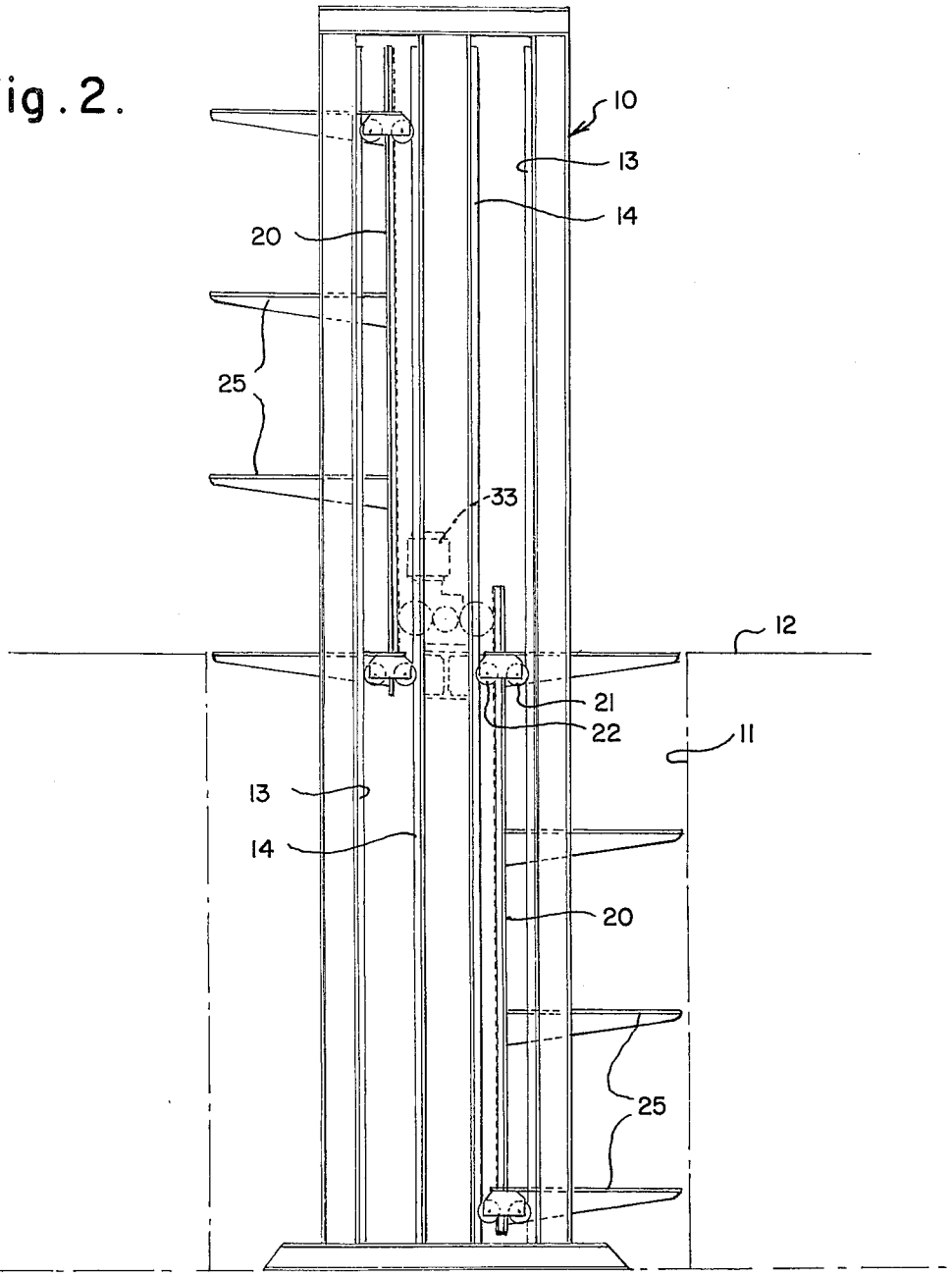
FIG. 2 is a side elevational view of the storage rack of FIG. 1.
Figure 3:
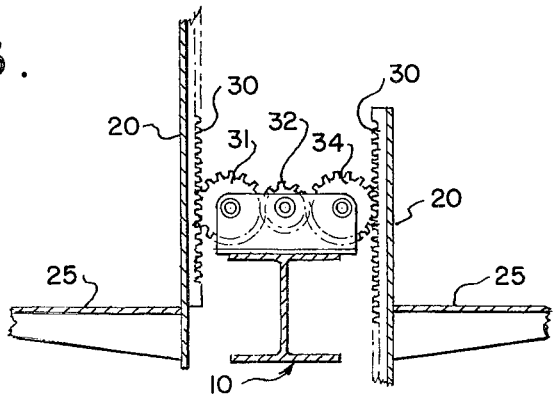
FIG. 3 is an enlarged fragmentary side elevational view of the storage rack of FIG. 1, partly in section showing the drive arrangement.

Referring to the drawings, I have illustrated a main elongate vertical frame 10 resting in the bottom of a well 11 below a floor or work surface 12 and extending above floor 12 a distance substantially equal to the distance from the bottom of the well to the floor. Main frame 10 is provided with a pair of spaced apart guide rails 13 and 14 at each side edge. A storage rack frame 20 of generally rectangular shape having a width generally the same as that of the main frame and a length generally equal to half of the height of the main frame. The storage rack frame 20 is provided with pairs of guide wheels 21 and 22 adjacent its top and bottom, all adapted to engage and run between parallel guide rails 13 and 14 at each side edge. Shelves 25 are cantilevered outwardly from storage rack frame 20 at selected spaced intervals. A rack 30 is fixed on the back of storage rack frame 20 and is drivingly engaged by drive motor 33 on the main frame 10. A like storage rack 20 is similarly mounted on the opposite side of main frame 10 and is driven by a drive gear 34 driven by gear 32. As a result, when the motor 33 drives gear 32 in the counterclockwise direction, rack 20 on the left, viewing FIG. 1, is raised while rack 20 on the right is lowered and when gear 32 is driven in the clockwise direction, the reverse occurs. This provides a very effective counterbalance effect without the need for added sliding weights, sheaves or cables.

As can be seen from the drawings, any shelf on either rack 20 can be selectively positioned with respect to the level of floor or work surface 12 with ease and relatively little work because of the counterbalancing effect.

In the foregoing specification I have set out certain preferred practices and embodiments of this invention; however, it will be understood that this invention may be otherwise embodied within the scope of the following claims.

I claim:

1. A vertically reciprocable storage rack assembly comprising a vertical main frame, guide means adjacent each side edge of said frame, vertical storage rack frames, each having a length substantially half the length of the main frame on two opposite sides of said main frame, guide means on each of said storage rack frames on two opposite sides of said main frame cooperating with the guide means on the main frame to support and maintain said guide in the vertical position throughout the length of the main frame, spaced shelves on said storage rack frame, drive means on the main frame drivingly engaging said storage rack frame for movement vertically thereon and well means beneath the level of a selected working surface, said well means being equal in depth to substantially the length of the storage rack frame, said main frame being mounted in said well whereby the top of the storage frame is substantially at the level of the working surface in its lowermost position and the bottom of the storage rack frame is substantially level with the working surface at its uppermost positions, said drive means includes a geared rack on each storage rack frame, each in driving engagement with a drive gear on opposite sides of a main drive gear whereby said racks are driven in opposite directions when the main drive gear rotates.

2. A vertically reciprocable storage rack as claimed in claims 3 wherein the guide means on the main frame are a pair of spaced guide rails at each side edge of the frame and the cooperating guide means on the storage rack frame are at least two pairs of guide wheels, one adjacent the top and one adjacent the bottom of said rack frame and engaged between said spaced parallel rails.

3. A vertically reciprocable storage rack as claimed in claims 3 wherein the guide means on the main frame is a single guide rail adjacent each side edge of said main frame and the cooperating guide means on the storage rack frame is spaced pairs of wheels, one on each side of said rail.

4. A vertically reciprocable storage rack as claimed in claims 3 wherein the guide means on the main frame are spaced guide wheels engaging on opposite sides of a rail on each side of the storage rack frame forming the cooperating guide means thereon.

* * * * *

UNITED STATES PATENT AND TRADEMARK OFFICE

CERTIFICATE OF CORRECTION

PATENT NO. : 4,329,928

DATED : May 18, 1982

INVENTOR(S) : ALVIN W. SHAW

It is certified that error appears in the above-identified patent and that said Letters Patent are hereby corrected as shown below:

On the Title Page, column 1 under References Cited, the date of the Tantlinger patent should be --1/1966--.

On the Title Page, column 2, under FOREIGN PATENT DOCUMENTS, the United Kingdom patent should be --800182--.

Claim 2, column 3, line 18, "claims 3" should be --claim 1--.

Claim 3, column 4, line 8, "claims 3" should be --claim 1--.

Claim 4, column 4, line 14, "claims 3" should be --claim 1--.

Signed and Sealed this

*Twelfth* Day of *October 1982*

[SEAL]

*Attest:*

GERALD J. MOSSINGHOFF

*Attesting Officer*

*Commissioner of Patents and Trademarks*